United States Patent [19]

Röck et al.

[11] 3,977,041

[45] Aug. 31, 1976

[54] HINGE DEVICE

[75] Inventors: Erich Röck, Hochst; Bernhard Mages, Dornbirn, both of Austria

[73] Assignee: Blum Gesellschaft m.b.H., Hochst, Austria

[22] Filed: Dec. 19, 1974

[21] Appl. No.: 534,346

[30] Foreign Application Priority Data

Dec. 31, 1973 Austria ..... 10906/73

[52] U.S. Cl. ..... 16/129

[51] Int. Cl.[2] ..... E05D 7/04

[58] Field of Search ..... 16/129–135, 16/128 R, 139, 140, 144

[56] References Cited

UNITED STATES PATENTS

| | | | |
|---|---|---|---|
| 3,596,307 | 8/1971 | Kolmetsky | 16/129 |
| 3,772,735 | 11/1973 | Lautenschlaeger | 16/129 |

*Primary Examiner*—G.V. Larkin

*Attorney, Agent, or Firm*—Wenderoth, Lind & Ponack

[57] ABSTRACT

A Hinge device includes a hinge arm which embraces an intermediate part insertable into and lockable on a mounting plate. The hinge arm rests on an adjustment part which rests on the intermediate part and by which the hinge arm is displaceable in the depth direction of the furniture.

9 Claims, 4 Drawing Figures

HINGE DEVICE

BACKGROUND OF THE INVENTION

The invention relates to a hinge device including a mounting plate to be fixed e.g. on the side wall of a piece of furniture, a hinge arm directly or indirectly connected with the mounting plate and provided with swivel pin bearings and with a cross section that embraces the mounting plate like a U, and an intermediate part situated between the mounting plate and the hinge arm.

Hinge devices of the above type are known and usually permit a readjustment in the direction of the depth of the furniture, as well as adjustment of the door gap, in order to correct for errors which have occurred during assemblage of the mounting plate.

A disadvantage of the conventional hinge devices is to be seen in the fact that the very assemblage of the hinge, i.e. the assemblage of the hinge arm onto the mounting plate is relatively difficult, as the adjustment must be done with the whole door, a fact that makes an exact adjustment considerably more difficult. In the present conventional hinge devices the mounting of the hinge arm and the adjustment of any existing errors are carried out simultaneously, since a loosening of the adjustment screws which permits the readjustment, also means a loosening of the hinge arm from the mounting plate.

SUMMARY OF THE INVENTION

A further disadvantage of the conventional hinge devices is to be seen in the fact that a height adjustment of the door is not possible.

Therefore the objects of the invention are to make possible adjustments in the directions both of the depth and the door gap at a later time without loosening the door's anchoring in the mounting plate.

According to the invention this is achieved by providing an adjustment part which is situated between the intermediate part and the hinge arm and which is connected with the intermediate part by an adjustment screw provided with a fixing screw as a means to clamp or to fasten the hinge arm to the adjustment part.

As an advantage the adjustment part is provided with a substantially U-shaped configuration to embrace or surround the intermediate part.

In a preferred embodiment the hinge arm is provided with slots for the fixing screw and, preferably, also for the adjustment screw in order to permit the adjustment in the direction of the depth of the furniture.

BRIEF DESCRIPTION OF THE DRAWINGS

An embodiment of the invention is hereinafter described in detail with reference to the attached drawings.

DETAILED DESCRIPTION OF THE INVENTION

Figure 4:
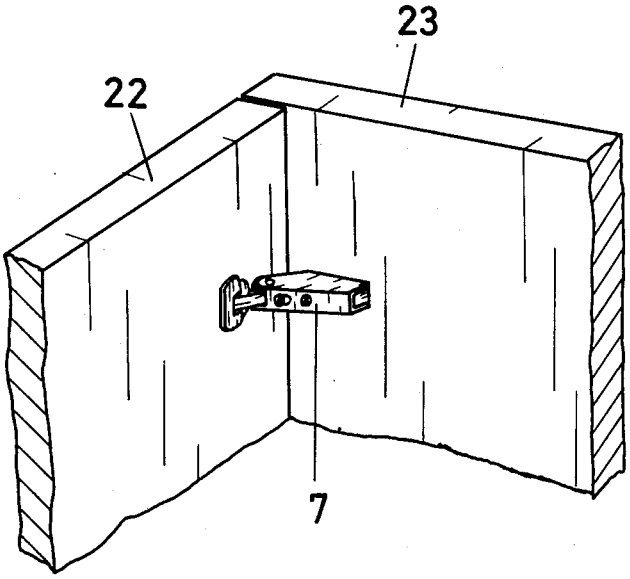
FIG. 4 is a sectional view of a furniture door mounted onto a furniture side wall by a hinge according to the invention.

The hinge device according to the invention includes a mounting plate 1 which can be fixed by screws, dowels or similar means, preferably to a furniture side wall, such as 23 in FIG. 4. The particular way of fixation is not dealt with here in further detail as it does not involve the concept of the invention and would be known to anyone skilled in the art.

Figure 1:
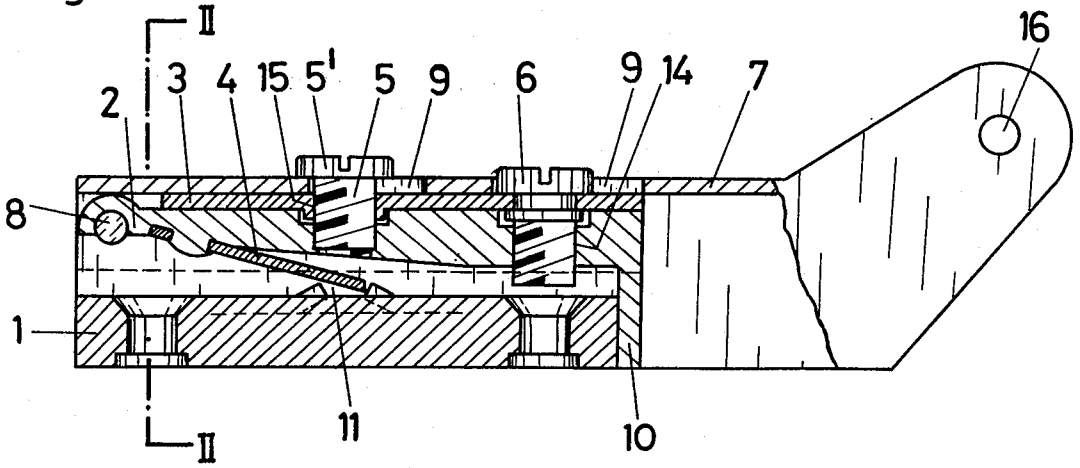
FIG. 1 is a longitudinal section of a hinge device according to the invention.

In the embodiment shown in FIG. 1, the mounting plate 1 is provided with lateral resesses or guides 12 into which are inserted corresponding lateral projections 13 of the intermediate part 2.

In this case the intermediate part 2 embraces or surrounds the mounting plate 1.

The inner end, with respect to the furniture, of the intermediate part 2 is provided with a spring that forms a locking bar 4 which is linked to part 2 by means such as a bolt.

When the intermediate part is inserted onto mounting plate 1, with projections 13 in guides 12, the locking bar 4 snaps into the abutment 11, while another abutment 10 of the intermediate part 2 abuts against the front wall of the mounting plate 1 at the end thereof nearest to the furniture door 22.

The intermediate part 2 and the parts connected therewith are thus anchored rigidly on the mounting plate 1 by simple insertion of the intermediate part 2 into the mounting plate 1.

As can be seen from the drawings, the mounting plate 1 is preferably designed to allow the fastening thereof to the furniture side wall 23 without paying attention as to which one of its two ends points to the door 22.

Figure 2:
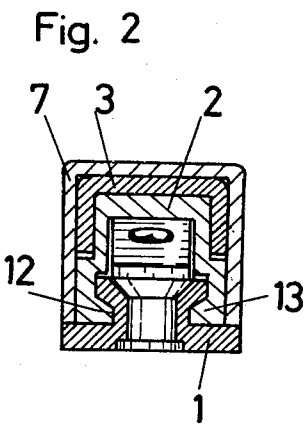
FIG. 2 is a cross section of a hinge device according to the invention.

As can be seen especially from FIG. 2 the intermediate part 2 has positioned on the top thereof an adjustment part 3 having a substantially U-shaped configuration. In this case the adjustment part 3 is connected with the intermediate part 2 by an adjustment screw 6 which screws into a thread 14 of the intermediate part 2.

By fastening or loosening the adjustment screw 6 the gap of the furniture door 22 is adjusted. That is, fastening or loosening of screw 6 causes lowering or raising of adjustment part 3 with respect to intermediate part 2.

Figure 3:
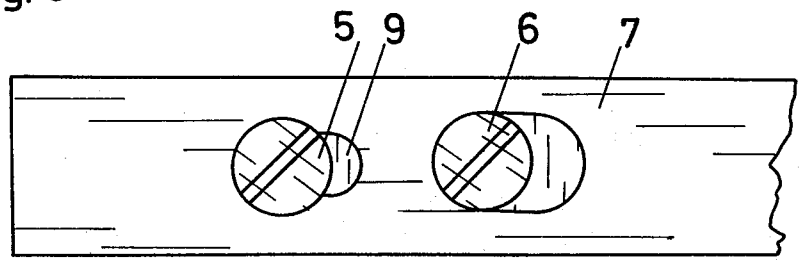
FIG. 3 is a top elevational view of a hinge device according to the invention.

Furthermore the adjustment part 3 has a thread 15 into which extends a fixing screw 5. As can be seen from FIGS. 1 and 3 the fixing screw 5 projects through a slot 9 of the hinge arm 7 and its head 5' abuts against hinge arm 7. If the hinge arm 7 is to be displaced in the direction of the depth of the furniture it is only necessary to loosen the fixing screw 5 in order to be able to displace the hinge arm 7 by the length of the slot 9 in the direction of the depth of the furniture. When the hinge arm 7 is in the desired position the fixing screw 5 is fastened again, which clamps or fixes the depth direction of the hinge arm 7 with respect to the adjustment part 3.

In order to prevent the adjustment screw 6 of the adjustment part 3 from inhibiting the displacement of hinge arm 7, the hinge arm 7 is provided with a corresponding slot in the area of the head of the adjustment screw 6.

The embodiment of a hinge device according to the invention offers a complete separation of the functions of anchoring of the hinge arm 7 with respect to the door 22, and of the actual adjusting thereof.

In FIG. 1 of the drawings the bearings 16 for the swivel pins are shown, but this part of the hinge and hinge arm will not be dealt with in further detail, as the hinge device according to the invention can be combined with any conventional hinge or linkage system.

What is claimed is:

1. A hinge device, particularly for mounting a door to a piece of furniture, said device comprising:

a mounting plate adapted to be attached to a piece of furniture, said mounting plate having recesses along opposite sides thereof;

an intermediate part positioned on the top of said mounting plate, said intermediate part having projections received in said recesses, said intermediate part being fixed with respect to said mounting plate;

an adjustment part positioned on the top of said intermediate part and adjustably movable toward and away therefrom; and a hinge arm adjustably connected to said adjustment part and having a substantially U-shaped lateral cross-sectional configuration, said hinge arm being adjustably movable with respect to said adjustment part in said longitudinal direction.

2. A device as claimed in claim 1, further comprising a downwardly extending first abutment on said intermediate part, said first abutment abutting against a longitudinal end of said mounting plate.

3. A device as claimed in claim 2, further comprising a locking bar extending downwardly from said intermediate part and engaging a second abutment located on said mounting plate.

4. A device as claimed in claim 1, further comprising an adjustment screw threaded into said intermediate part and carrying said adjustment part, said adjustment screw comprising means for selectively moving said adjustment part toward and away from said intermediate part.

5. A device as claimed in claim 4, further comprising a fixing screw attaching said hinge arm to said adjustment part.

6. A device as claimed in claim 5, further comprising first and second slots in said hinge arm, said adjustment screw and said fixing screw each extending through one of said slots, said slots thereby providing means for allowing said hinge arm to be adjusted in said longitudinal direction.

7. A device as claimed in claim 6, wherein said fixing screw includes a head abutting the outer surface of said hinge arm, and said adjustment screw includes a head positioned within one of said slots.

8. A device as claimed in claim 1, wherein said adjustment part has a substantially U-shaped lateral cross-sectional configuration and embraces said intermediate part.

9. A device as claimed in claim 1, wherein said recesses extend in a longitudinal direction in opposite lateral sides of said mounting plate, and said projections extend longitudinally within said recesses.

* * * * *

UNITED STATES PATENT OFFICE

CERTIFICATE OF CORRECTION

Patent No. 3,977,041 Dated August 31, 1976

Inventor(s) Erich Rock, et al

It is certified that error appears in the above-identified patent and that said Letters Patent are hereby corrected as shown below:

The term of this patent subsequent to May 18, 1993, has been disclaimed.

Signed and Sealed this

Fifth Day of October 1976

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,977,041 Dated August 31, 1976

Inventor(s) Erich Rock et al.

It is certified that error appears in the above-identified patent and that said Letters Patent are hereby corrected as shown below:

The following should be deleted:

"The term of this patent subsequent to May 18, 1993 has been disclaimed."

This certificate supersedes Certificate of Correction issued October 5, 1976.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*